US010206496B1

(12) United States Patent
Miller

(10) Patent No.: US 10,206,496 B1
(45) Date of Patent: Feb. 19, 2019

(54) INTEGRATED FOLDABLE TABLE AND BENCH ASSEMBLY

(71) Applicant: Barry Miller, York, PA (US)

(72) Inventor: Barry Miller, York, PA (US)

( * ) Notice: Subject to any disclaimer, the term of this patent is extended or adjusted under 35 U.S.C. 154(b) by 0 days.

(21) Appl. No.: 15/833,872

(22) Filed: Dec. 6, 2017

(51) Int. Cl.
*A47B 3/14* (2006.01)

(52) U.S. Cl.
CPC ..... *A47B 3/14* (2013.01); *A47B 2003/145* (2013.01)

(58) Field of Classification Search
CPC ..... A47B 3/14; A47B 2003/145; A47B 85/02; A47B 2220/07
USPC ..... 297/124, 158.5, 158.4
See application file for complete search history.

(56) References Cited

U.S. PATENT DOCUMENTS 1,792,737 A * 2/1931 Greenstreet ..... A47B 83/02 297/121
2,481,935 A * 9/1949 Larson ..... A47B 85/04 297/121
4,615,559 A * 10/1986 Blondeau ..... A47B 3/14 297/124
4,662,675 A * 5/1987 Volpi ..... A47C 11/00 297/124
6,231,121 B1 * 5/2001 Chrisco ..... A47B 85/04 297/124
D470,666 S * 2/2003 Peloquin ..... D6/336
8,720,990 B2 * 5/2014 Boydston ..... A47B 85/04 297/173

* cited by examiner

*Primary Examiner* — Milton Nelson, Jr.
(74) *Attorney, Agent, or Firm* — Gulf Coast Intellectual Property Group

(57) ABSTRACT

A table and bench assembly that is configurable between a first position and a second position. In the first position the table and bench assembly is configured to provide a seating arrangement for a user. In the second position the table and bench assembly is configured to provide a combined seating and table arrangement for the user. A seating support member and tabletop support member are provided. A frame is further included wherein the frame further includes a pair of first leg members and a pair of second leg members. A seat brace member is provided and provides support for the seating support member. A seat member leg assembly includes a first portion and a second portion and is pivotally coupled to the seat brace member. The tabletop support member includes a plurality of longitudinal support members that further include at least one notch operable to engage a clamping member.

15 Claims, 7 Drawing Sheets

INTEGRATED FOLDABLE TABLE AND BENCH ASSEMBLY

FIELD OF THE INVENTION

The present invention relates generally to seating apparatus, more specifically but not by way of limitation, an integrated table and bench that is configured to remain operably coupled and move intermediate a folded position and an open position.

BACKGROUND

Whether for temporary use to accommodate additional people or for installation at an outdoor event it is common to set up tables for various events such as but not limited to picnics. There are numerous types of tables available that have at least one folding member incorporated therein. The most common are lightweight tables that have integrally formed therewith a pair of folding leg members. As is known in the art the folding leg members typically are configured to fold inward so as to be placed in a position adjacent to the bottom surface of the table to place the table in a configuration that is easier to transport and store.

One issue with the aforementioned tables is that they do not have integrated seats and/or benches. The lack of seats or benches with the conventional folding tables precipitates a requirement to provide these separately. This requires inconveniences such as but not limited to additional storage for the chairs or benches and seats. Further while some attempts have been made at integrated table and seat no existing technology provides the ability to provide an integrated table and seat and further provide the ability for the apparatus to be configurable as a seating apparatus only.

Accordingly, there is a need for a integrated table and bench assembly that is configurable either as a bench is a first position or can be configured as a bench and table wherein two of the assemblies of the present invention can be operably coupled to create a larger bench and table assembly.

SUMMARY OF THE INVENTION

It is the object of the present invention to provide a bench and table assembly that is configured to have an integrated seating support surface and a tabletop support surface.

Another object of the present invention is to provide a bench and table assembly operably configured to transition intermediate a folded position and a deployed position wherein the deployed position has a first configuration and a second configuration.

A further object of the present invention is to provide an integrated table and bench assembly wherein in the first deployed configuration the table and bench assembly is configured as a bench for supporting users in a seated position.

Still another object of the present invention is to provide a bench and table assembly that is deployable in a second configuration wherein in the second configuration the tabletop support surface is placed in a horizontal position so as to provide a bench support surface and a tabletop support surface for a user.

An additional object of the present invention is to provide an integrated foldable table and bench assembly wherein the assembly of the present invention is configurable to be operably coupled to a second assembly wherein the first assembly and second assembly are identically constructed.

Yet a further object of the present invention is to provide a bench and table assembly that is configurable in a first position and a second position wherein in the first position the tabletop surface is in a vertical position so as to provide a rear support for a user in a seated position.

Another object of the present invention is to provide an integrated table and bench assembly that is configured to be foldable intermediate a first and second deployed position and a folded position wherein the table top support surface includes longitudinal support members on the rear surface thereof.

Still a further object of the present invention is to provide a bench and table assembly that is configurable in a first position and a second position wherein the longitudinal support members include integrally formed notches.

Yet a further object of the present invention is to provide an integrated table and bench assembly that is configured to be foldable intermediate a first and second deployed position and a folded position that further includes a clamp member wherein the clamp member is deployed during operable coupling of a first assembly and second assembly.

An alternative object of the present invention is to provide a table and bench assembly configured to be foldable for storage thereof wherein the clamp member is configured to be operably engaged with the longitudinal support members of the tabletop support surface.

A further object of the present invention is to provide an integrated table and bench assembly that further includes a keeper configured to secure the clamp member to the table and bench assembly.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
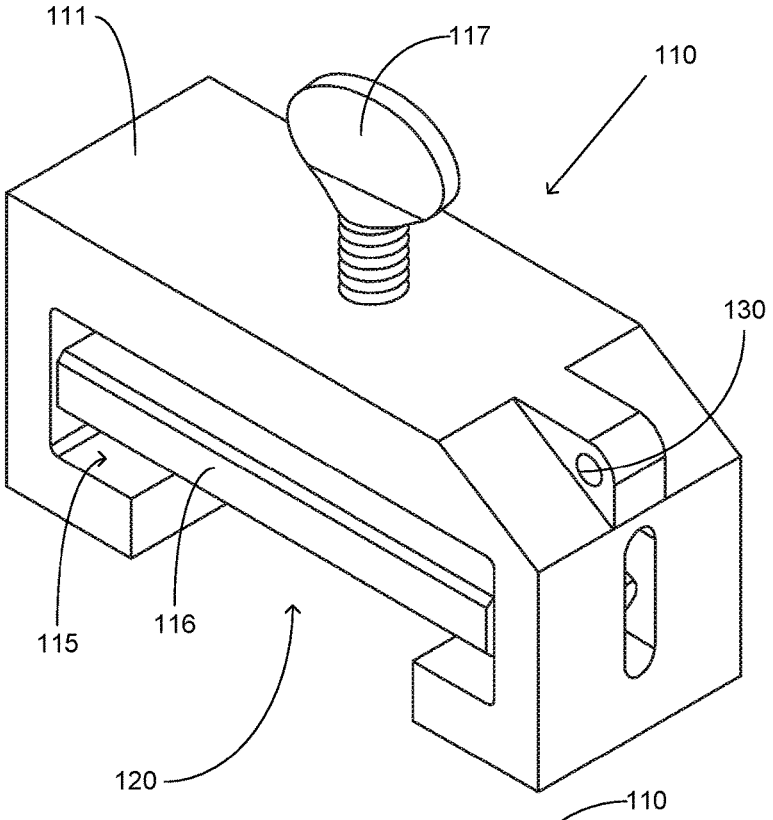
FIG. 1 is a perspective view of a clamp of the present invention of the bench and table assembly.
Figure 2:
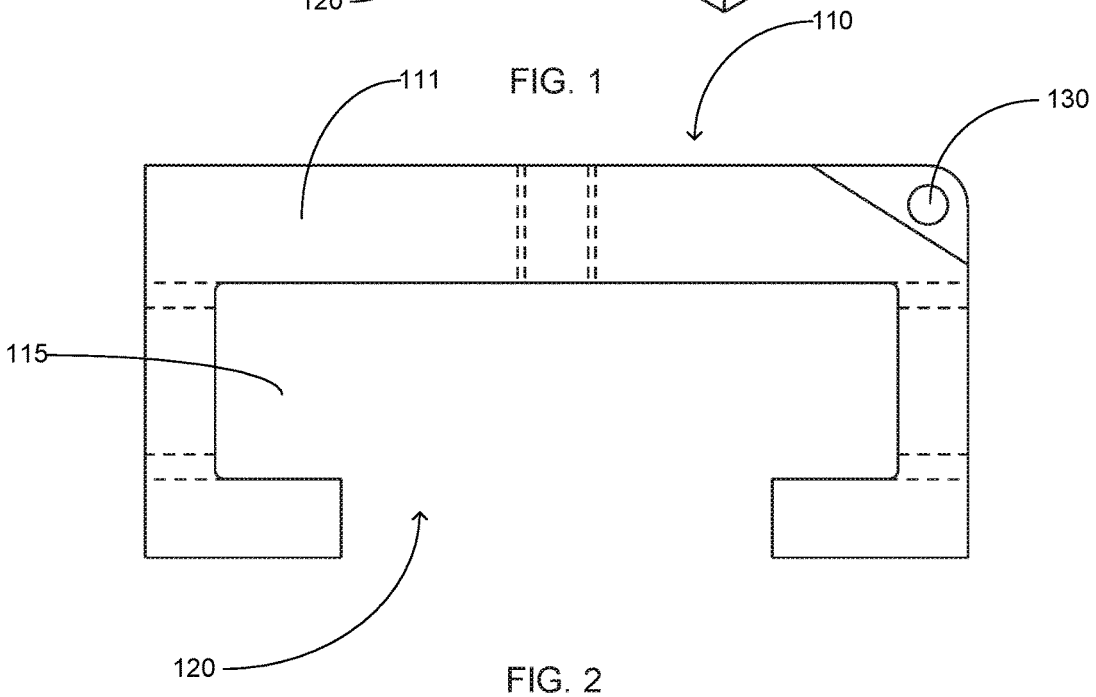
FIG. 2 is a side view of the clamp body of the present invention.
Figure 3:
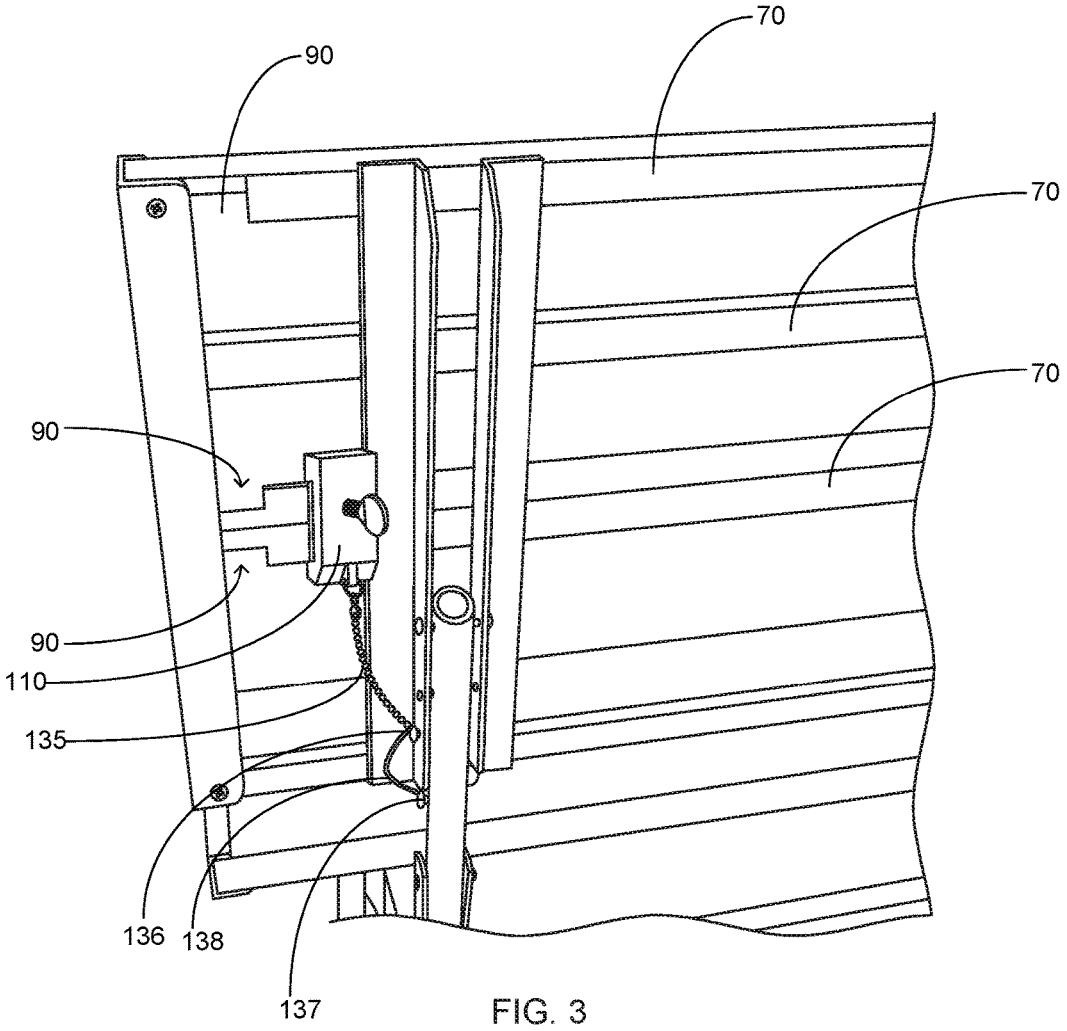
FIG. 3 is a rear view of a portion of the second support surface of the present invention.

Referring now to the drawings submitted herewith, wherein various elements depicted therein are not necessarily drawn to scale and wherein through the views and figures like elements are referenced with identical reference numerals, there is illustrated a bench and table assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 6:
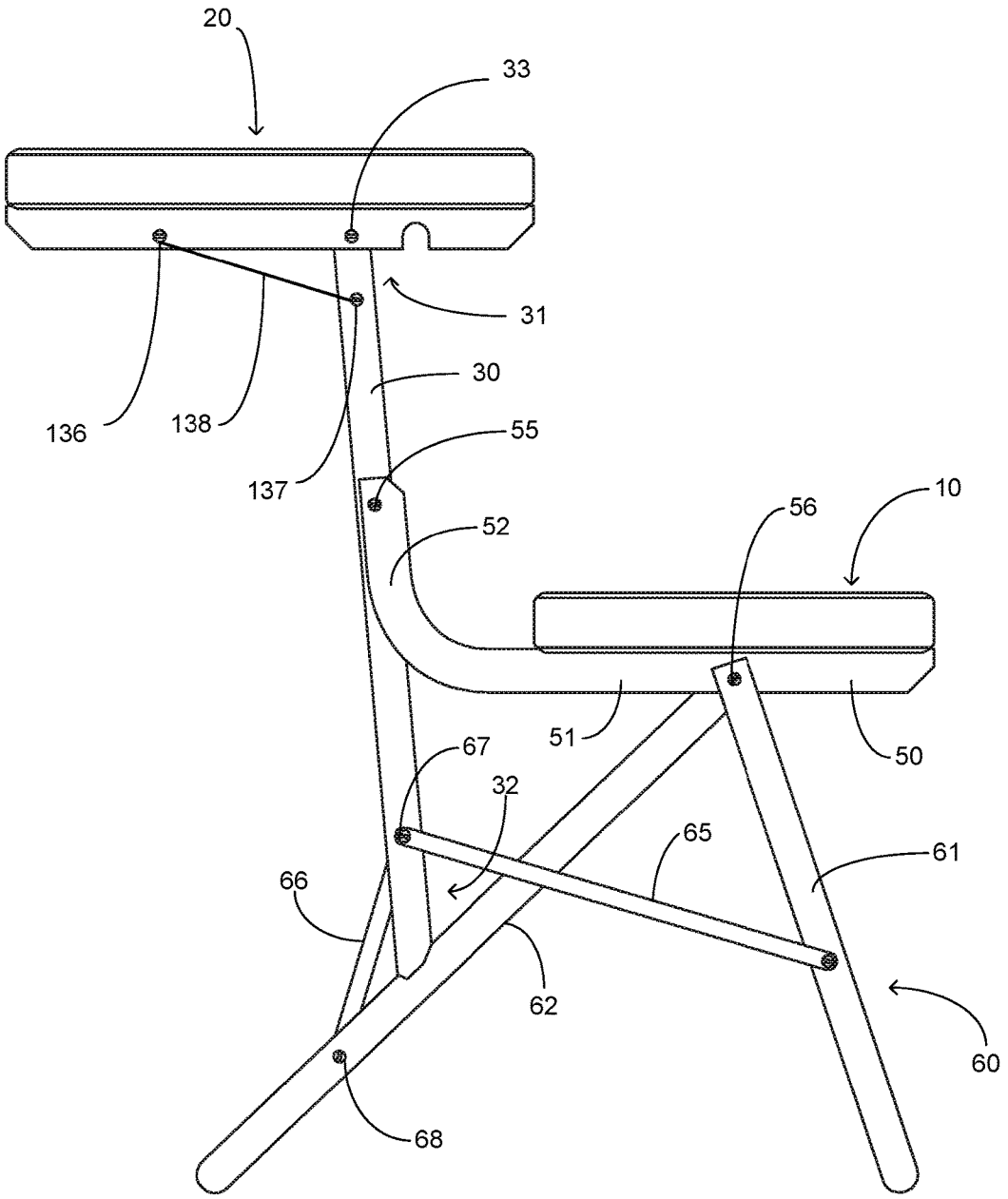
FIG. 6 is a side view of an assembly of the present invention in the table top configuration.
Figure 7:
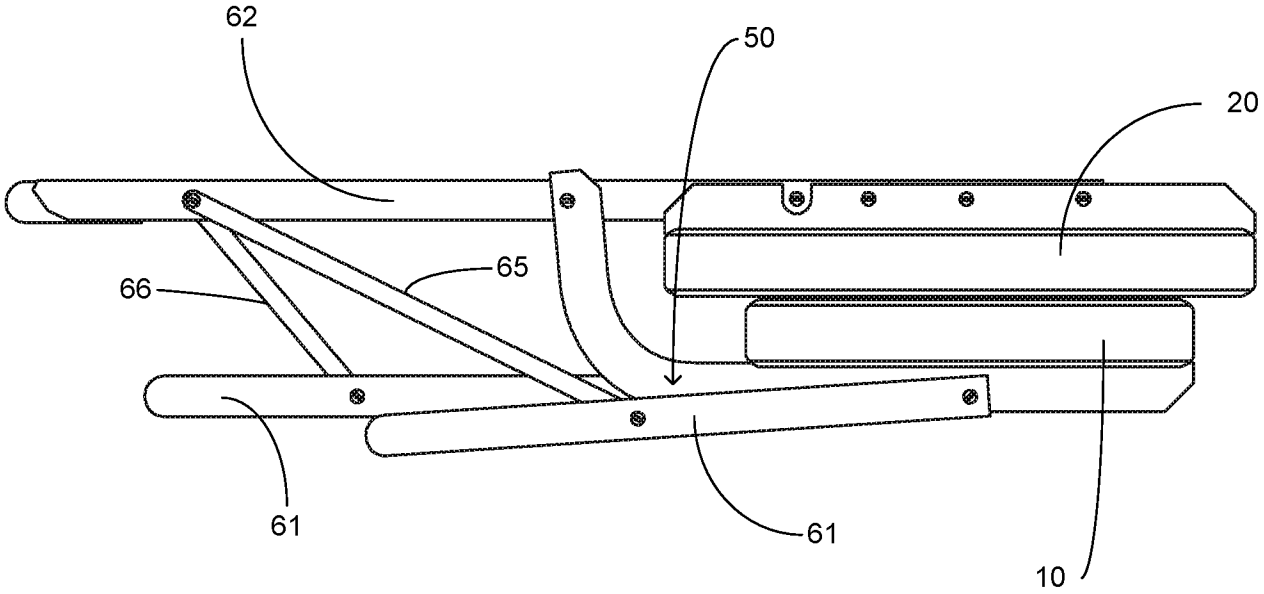
FIG. 7 is a side view of the present invention in a folded position.
Figure 8:
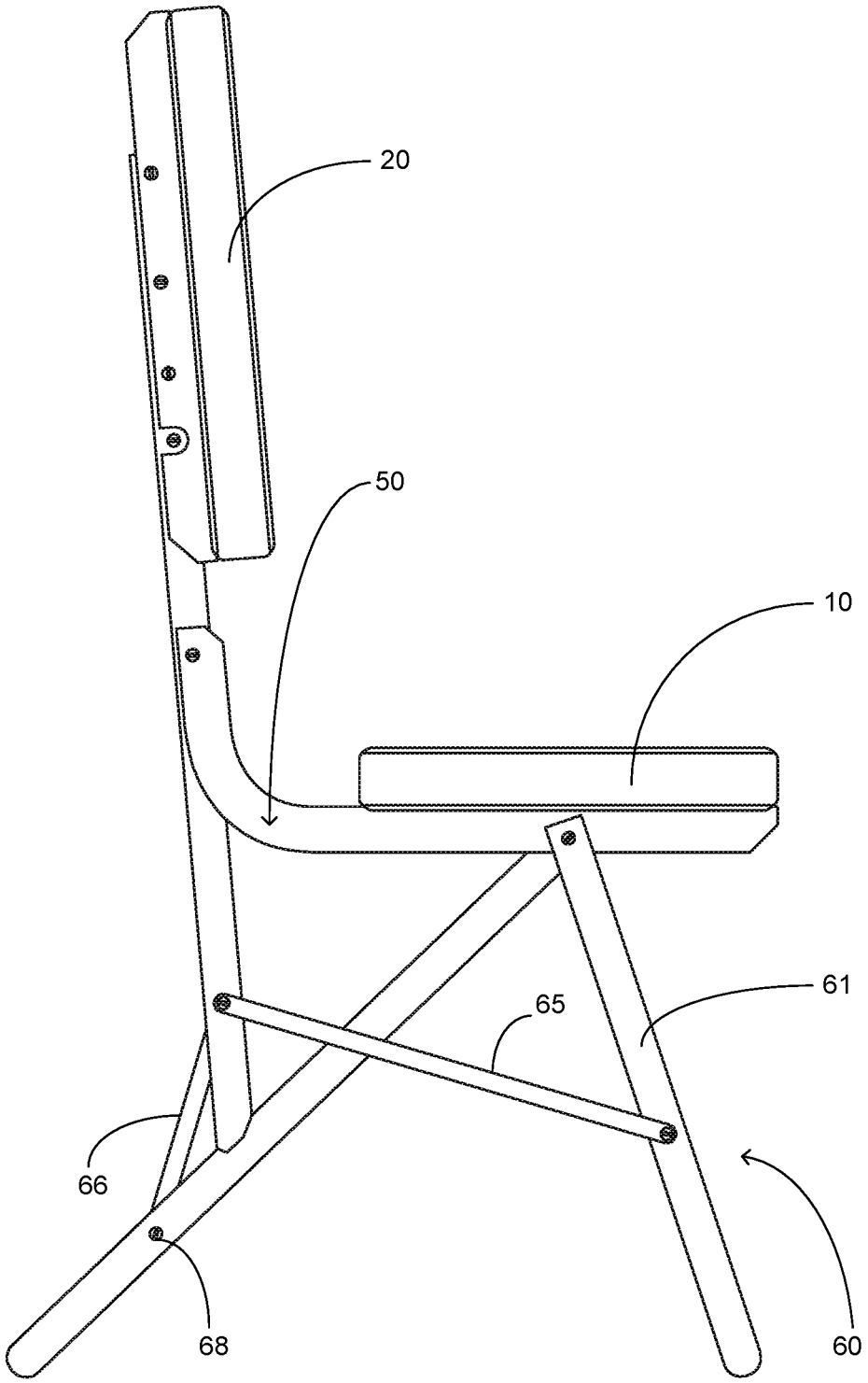
FIG. 8 is a side view of the present invention in a bench configuration.

Referring to the drawings submitted herewith, the bench and table assembly 100 includes a seating support member 10, frame 15 and tabletop support member 20 operably coupled to provide a first configuration and a second configuration of the bench and table assembly 100 as will be further discussed herein. The seating support member 10 is operably coupled to the frame 15 as is further discussed herein and is manufactured from a durable lightweight rigid material such as but not limited to aluminum. The seating support member 10 is horizontal in manner in both the first configuration and second configuration of the bench and table assembly 100. The seating support member 10 extends the length of the frame 15 and the shape thereof is defined by perimeter edge 11. While the seating support member 10 is illustrated herein as being rectangular in shape, it is contemplated within the scope of the present invention that the seating support member 10 could be formed in alternate shapes. The seating support member 10 includes upper surface 12 that is horizontal in manner and is configured to provide a suitable surface for a user to superpose thereon in a seated position. The seating support member 10 is in horizontal position in both the first configuration and the second configuration of the bench and table assembly 100. In its first configuration the bench and table assembly 100 is positioned such that the seating support member 10 is as shown in FIG. 6 however the tabletop support member 20 is positioned vertically as opposed to horizontally so as to provide a rear backrest type support for a user superposed on the seating support member 10. FIG. 6 specifically illustrates the second configuration of the bench and table assembly 100 wherein the tabletop support member 20 is in a horizontal configuration so as to provide a suitably oriented surface for placing objects thereon. In the second configuration, the seating support member 10 is also in a horizontal position so as to place the bench and table assembly 100 in a usable position similar to a conventional bench and table wherein a user may sit on the seating support member 10 and place objects on the tabletop support member 20.

Referring in particular to FIG. 6, the frame 15 includes first leg member 30. It should be understood that FIG. 6 is a side view and that the first leg member 30 is present as part of the frame 15 on the opposing side of the frame 15. The first leg member 30 is manufactured from a durable rigid material such as but not limited to aluminum. The first leg member 30 includes first end 31 and second end 32. First end 31 is pivotally coupled to tabletop support member 20 utilizing fastener 33. While not illustrated herein, when the bench and table assembly 100 is moved to the first configuration, the tabletop support member 20 is pivotally moved on fastener 33.

The frame 15 further includes seat brace member 50. It should be understood that the seat brace member 50 is present on both opposing ends of the bench and table assembly 100. The seat brace member 50 includes a first portion 51 and a second portion 52 wherein the first portion 51 and second portion 52 are contiguous. Second portion 52 is arcuately transitioned from first portion 51 wherein the second portion 52 is generally vertical in orientation with respect to the first portion 51. Second portion 52 is operably secured to the second leg member 30 using fastener 55. The seat brace member 50, specifically the first portion 51 thereof is pivotally coupled to the seat member leg assembly 60 utilizing fastener 56. The seat member leg assembly 60 includes first portion 61 and second portion 62. First portion 61 and second portion 62 are angularly oriented when the bench and table assembly 100 is deployed in its second configuration and illustrated herein in FIG. 6. First portion 61 and second portion 62 are pivotally coupled to seat brace member 50 utilizing fastener 56. Operably coupled to first portion 61 and second leg member 30 is brace member 65. Brace member 65 is operable to maintain spatial orientation and operable coupling of the first portion 61 and second leg member 30 during the transition of the bench and table assembly 100 intermediate the first configuration and the second configuration. Brace member 65 is a suitable rigid material such as but not limited to a metal bar. A second brace member 66 is operably coupled intermediate the second leg member 30 and the second portion 62. Second brace member 66 is pivotally coupled to the second leg member 30 utilizing fastener 67 and to the second portion 62 utilizing fastener 68. It should be understood that the seat member leg assembly 60 is identically present on both opposing sides of the bench and table assembly 100 so as to provide balanced structural support thereof. While a preferred configuration of the seat member leg assembly 60 has been illustrated herein, it is contemplated within the scope of the present invention that the seat member leg assembly 60 could be manufactured utilizing alternate elements and/or configurations and still achieve the desired objective stated herein.

Figure 4:
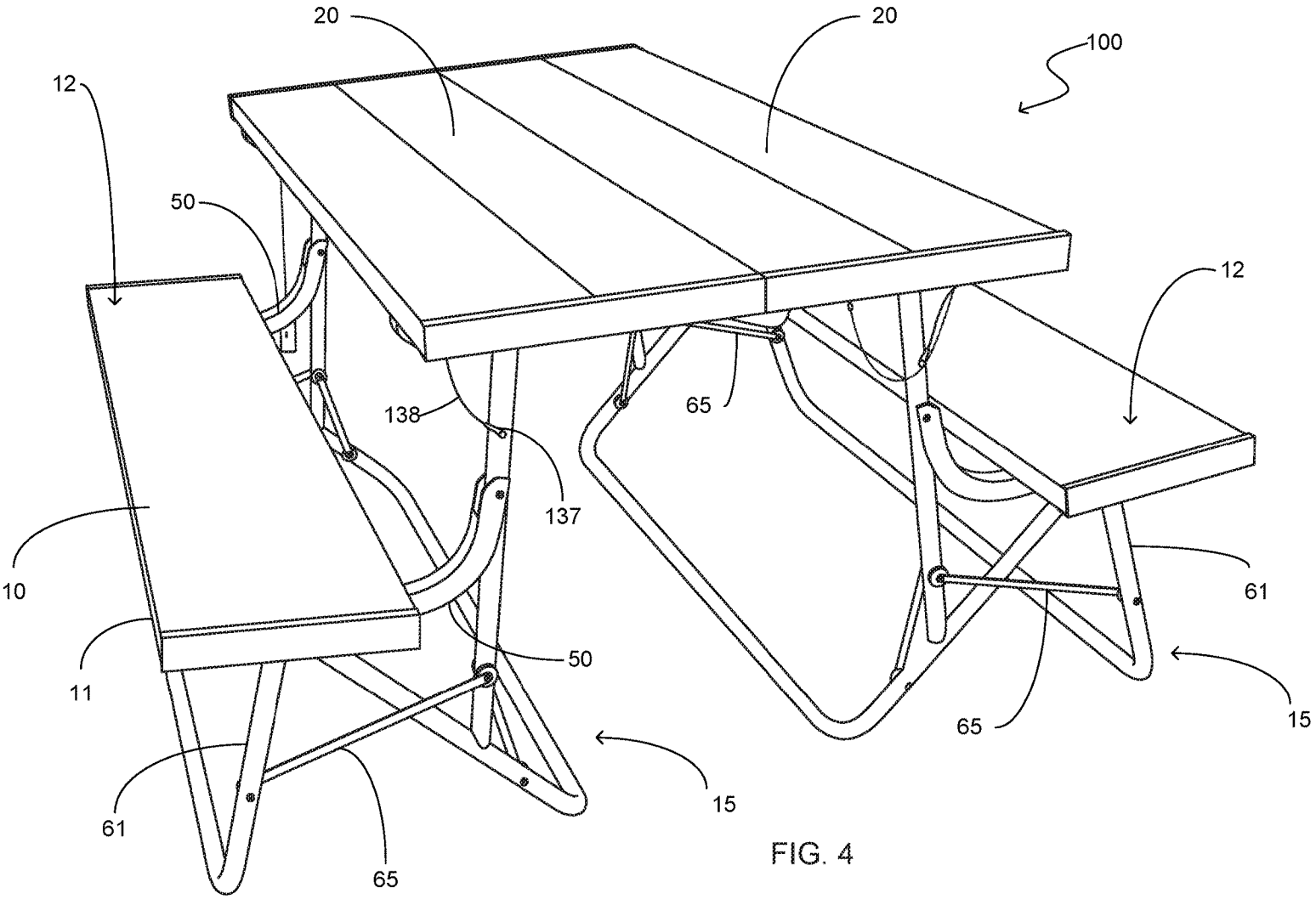
FIG. 4 is a perspective view of the present invention wherein a first assembly and a second assembly have been operably coupled.
Figure 5:
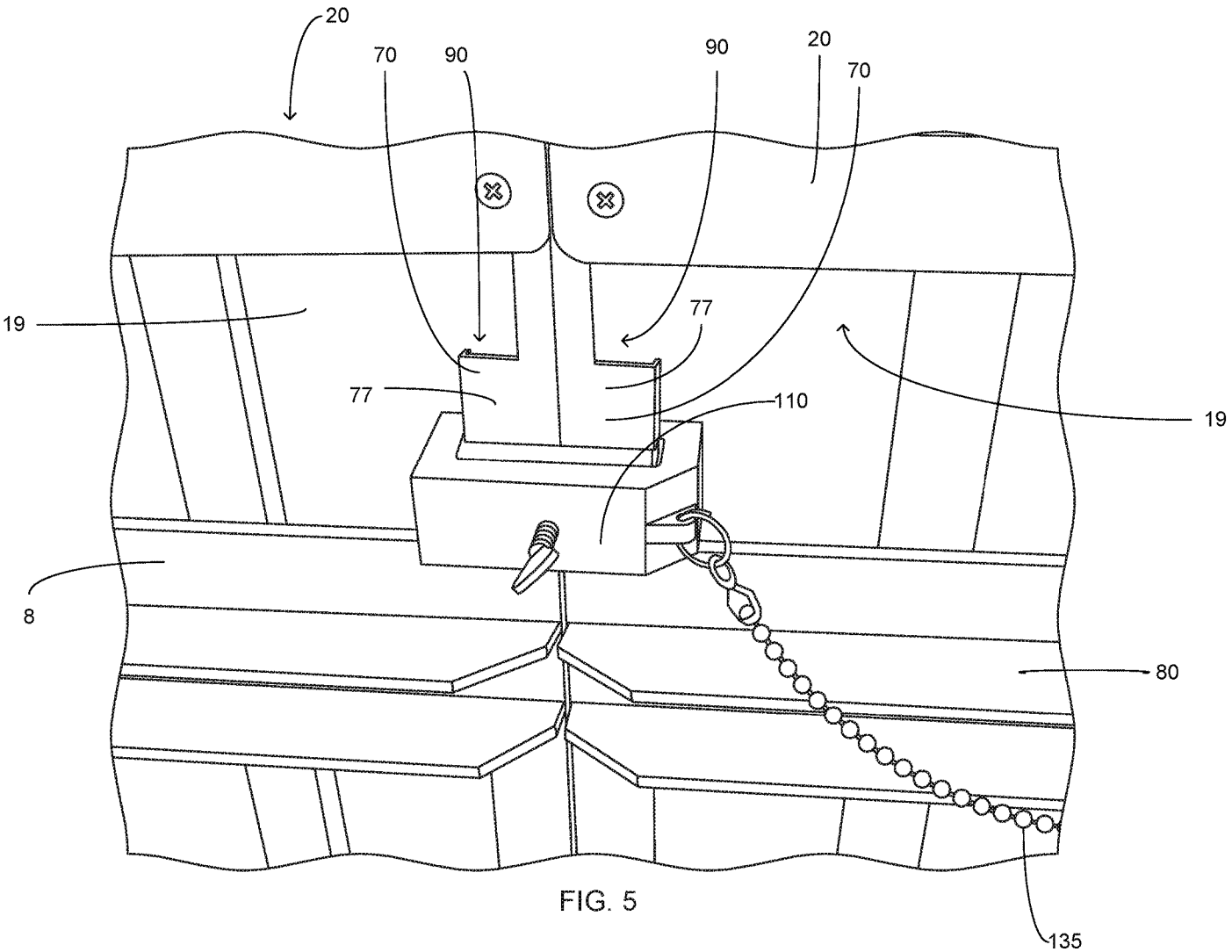
FIG. 5 is a detailed view of the rear surface of the second support surface of operably coupled second support surfaces.

Now referring to FIG. 5, the rear surface 19 of adjoining tabletop support members 20 is illustrated therein. FIG. 5 illustrates a detailed view of a portion of adjacent tabletop support members 20 when a first bench and table assembly 100 and a second bench and table assembly 100 are operably coupled as shown in FIG. 4 herein. The tabletop support member 20 includes longitudinal brace members 70 and horizontal brace members 80. The longitudinal brace members 70 and horizontal brace members 80 are secured to the rear surface 19 of the tabletop support member 20 utilizing suitable durable techniques such as but not limited to welding. The longitudinal brace members 70 and horizontal brace members 80 are operable to provide structural rigidity and support for the tabletop support member 20. It is contemplated within the scope of the present invention that the tabletop support member 20 could include alternate quantities of the longitudinal brace members 70 and horizontal brace members 80 wherein as few as one of each could be utilized or more than one longitudinal brace members 70 and horizontal brace members 80 could be present on the rear surface 19.

The longitudinal brace members 70 include notch 90 formed therein. Notch 90 is operable to facilitate the engagement of the clamp member 110 with the longitudinal brace members 70 so as to secure a first bench and table assembly 100 and a second bench and table assembly 100 as illustrated herein in FIG. 4. Notch 90 is formed utilizing suitable techniques and shaped so as to mateably engage opening 120 of the clamp member 110. Opening 120 is of sufficient width to engage opposing notches 90 and then be slidably traversed and secured to bottom surface 77 of the longitudinal brace members 70. It is contemplated within the scope of the present invention that the notch 90 could be formed in alternate shapes and sizes so as to facilitate the mateable engagement with the opening 120 of the clamp member 110. It is further contemplated within the scope of the present invention that the longitudinal brace members 70 could include various quantities of notches 90 so as to facilitate the use of more than one clamp member 110.

Clamp member 110 includes body 111 that is manufactured from a durable rigid material such as but not limited to metal. Clamp member 110 includes interior volume 115 that houses clamp bar 116. Clamp bar 116 is operably coupled to fastener 117 wherein fastener 117 is rotatably mounted to body 111. Fastener 117 rotates so as to move the clamp bar 116 in an upwards-downwards movement. Clamp bar 116 is a rectangular bar that is configured to engage the bottom surface 77 of the longitudinal brace members 70. The clamp bar 116 is sufficiently movable within the interior volume 115 so as to permit the clamp member 110 to slidably traverse along the longitudinal brace members 70 subsequent the clamp member 110 opening 120 being mateably presented to the notch 90. The clamp member 110 is slidably traversed beyond notch 90 upon wherein the fastener 117 is rotated so as to move the clamp bar 116 downward engaging the bottom surface 77 of the longitudinal brace members 70 and as such providing releasable securing thereof. The body 111 further includes aperture 130 configured to be operably coupled to chain 135. Aperture 130 and chain 135 provide a technique to releasably secure the clamp member 110 to the bench and table assembly 100 when not in use. Lanyard 138 is operably coupled intermediate shoulder screws 136, 137. While one lanyard 138 is illustrated herein, it should be understood within the scope of the present invention that a second lanyard 138 is present on the opposing end of the tabletop support members 20. It is contemplated within the scope of the present invention that the clamp member 110 could be releasably secured to the bench and table assembly 100 utilizing various suitable durable techniques.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bench and table assembly that is configurable in a first configuration and a second configuration wherein the bench and table assembly comprises:

a frame, said frame having a first end and a second end, said frame having a first leg member at said first end and said second end of said frame, said frame having a second leg member at said first end and said second end of said frame, said first leg member and said second leg member being operably coupled;

a tabletop support member, said tabletop support member being operably coupled to said first leg member and said second leg member, said tabletop support member being pivotally coupled to said first leg member and said second leg member, said tabletop support member having an upper surface and a lower surface, wherein said tabletop support member further includes at least one longitudinal support member, said longitudinal support member extending substantially the length of the tabletop support member, said longitudinal support member further including at least one notch formed therein;

a seat brace member, said seat brace member being operably coupled to said second leg member of said frame, said seat brace member having a first portion and a second portion;

a seat member leg assembly, said seat member leg assembly having a first portion and a second portion, said first portion and said second portion of said seat member leg assembly being angular in orientation in said first configuration and said second configuration, said seat member leg assembly being pivotally coupled to said seat brace member;

a seating support member, said seating support member being operably coupled to said seat brace member, said seating support member having an upper surface; and wherein in said first configuration said seating support member is horizontal in orientation and said tabletop support member is vertical in orientation so as to be perpendicular to said seating support member.

2. The bench and table assembly as recited in claim 1, and further including a clamp member, said clamp member being releasably secured to said frame, said clamp member configured to engage said at least one longitudinal support member.

3. The bench and table assembly as recited in claim 2, wherein in said second configuration, said tabletop support member and said seating support member are in a horizontal position.

4. The bench and table assembly as recited in claim 3, wherein in said first configuration, said first leg member and said second leg member of said frame are separated.

5. The bench and table assembly as recited in claim 4, wherein in said second configuration, said first leg member and said second leg member of said frame are adjacent.

6. The bench and table assembly as recited in claim 5, wherein said clamp member further includes an interior volume, said clamp member further having an opening providing access to said interior volume, said opening configured to engage said at least one longitudinal support member, said clamp member further having a clamp bar movably mounted within said interior volume.

7. A bench and table assembly that is configured to be foldable for transportation and wherein the bench and table assembly have a first configuration and a second configuration comprising:

a frame, said frame having a first end and a second end, said frame having a first leg member at opposing ends of said frame, said frame having a second leg member at opposing ends of said frame, said first leg members and said second leg member having a first end and a second end, said first leg member and said second leg member being operably coupled with a folding bar assembly proximate said first end thereof;

a tabletop support member, said tabletop support member being operably coupled to said first leg member and said second leg member, said tabletop support member being pivotally coupled to said first leg member and said second leg member, said tabletop support member having an upper surface and a lower surface, said tabletop support member being rectangular in shape, said tabletop support member having a first position in the first configuration and a second position in the second configuration, wherein in said first configuration said first leg member is adjacent said second leg member;

a pair of seat brace members, said pair of seat brace members being secured to said second leg member of said frame, said pair of seat brace members having a first portion and a second portion wherein said second portion of said pair of seat brace members is pivotally coupled to said pair of second leg members;

a seat member leg assembly, said seat member leg assembly having a first portion and a second portion, said first portion and said second portion of said seat member leg assembly being angular in orientation in said first configuration and said second configuration, said seat member leg assembly being pivotally coupled to said pair of seat brace members;

a seating support member, said seating support member being secured to said pair of seat brace members, said seating support member having an upper surface and a lower surface; and wherein in said first configuration said seating support member is horizontal in orientation and said tabletop support member is vertical in orientation so as to be perpendicular to said seating support member.

8. The bench and table assembly as recited in claim 7, wherein in said second configuration said tabletop support member is in a horizontal orientation and said first leg member is separated from said second leg member.

9. The bench and table assembly as recited in claim 8, and further including a plurality of longitudinal support members, said plurality of longitudinal support members being secured to said lower surface of said tabletop support members, said plurality of longitudinal support members having at least one notch formed therein.

10. The bench and table assembly as recited in claim 9, and further including a clamp member, said clamp member further including an interior volume, said clamp member further having an opening providing access to said interior volume, said opening configured to engage one of said plurality of longitudinal support member, said clamp member further having a clamp bar movably mounted within said interior volume.

11. The bench and table assembly as recited in claim 10, wherein said seat member leg assembly further includes a brace member, said brace member being pivotally coupled intermediate said first portion of said seat member and said pair of second leg members of said frame.

12. The bench and table assembly as recited in claim 11, wherein said clamp bar is operably coupled to a fastener, said fastener configured to move said clamp bar within said interior volume of said clamp member.

13. A bench and table assembly that is configured to be foldable for transportation and wherein the bench and table assembly having a first configuration and a second configuration comprising:

a frame, said frame having a first end and a second end, said frame having a first leg member at opposing ends of said frame, said frame having a second leg member at opposing ends of said frame, said first leg member and said second leg member having a first end and a second end, said first leg member and said second leg member being operably coupled with a folding bar assembly proximate said first end thereof;

a tabletop support member, said tabletop support member being operably coupled to said first leg member and said second leg member, said tabletop support member being pivotally coupled to said first leg members and said second leg members, said tabletop support member having an upper surface and a lower surface, said tabletop support member being rectangular in shape, said tabletop support member having a first position in the first configuration and a second position in the second configuration, wherein in said second configuration said tabletop support member is in a horizontal orientation and said first leg member is separated from said second leg member;

a plurality of longitudinal support members, said plurality of longitudinal support members being secured to said lower surface of said tabletop support members, said plurality of longitudinal support members having at least one notch formed therein;

a pair of seat brace members, said pair of seat brace members being operably coupled to said second leg members of said frame, said pair of seat brace members having a first portion and a second portion wherein said second portion of said pair of seat brace members is pivotally coupled to said second leg member;

a seat member leg assembly, said seat member leg assembly having a first portion and a second portion, said first portion and said second portion of said seat member leg assembly being angular in orientation in said first configuration and said second configuration, said seat member leg assembly being pivotally coupled to said pair of seat brace members;

a seating support member, said seating support member being operably coupled to said pair of seat brace members, said seating support member having an upper surface and a lower surface;

a clamp member, said clamp member further including an interior volume, said clamp member further having an opening providing access to said interior volume, said opening configured to engage one of said plurality of longitudinal support members, said clamp member further having a clamp bar movably mounted within said interior volume; and wherein in said first configuration said seating support member is horizontal in orientation and said tabletop support member is vertical in orientation so as to be perpendicular to said seating support member and wherein in said first configuration said pair of first leg members are adjacent said pair of second leg members.

14. The bench and table assembly as recited in claim 13, wherein said seat member leg assembly further includes a brace member, said brace member being pivotally coupled intermediate said first portion of said seat member and said second leg member of said frame.

15. The bench and table assembly as recited in claim 14, wherein said clamp bar is operably coupled to a fastener, said fastener configured to move said clamp bar within said interior volume of said clamp member.

* * * * *